US006410093B2

(12) United States Patent
Ohira et al.

(10) Patent No.: US 6,410,093 B2
(45) **Date of Patent: *Jun. 25, 2002**

(54) COATING METHOD FOR CYLINDRICAL BASE MEMBER

(75) Inventors: Akira Ohira; Junji Ujihara; Nobuaki Kobayashi; Masao Asano, all of Hachioji (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 8 days.

(21) Appl. No.: 09/224,584

(22) Filed: Dec. 31, 1998

(30) Foreign Application Priority Data

Jan. 9, 1998 (JP) ..... 10-002874

(51) Int. Cl.[7] ..... B05D 3/12

(52) U.S. Cl. ..... 427/356; 427/434.7; 118/405; 118/410; 118/411; 118/419; 118/DIG. 11; 425/467

(58) Field of Search ..... 425/467; 118/DIG. 11, 118/405, 410, 411, 419; 427/356, 434.7

(56) References Cited

U.S. PATENT DOCUMENTS 5,192,586 A * 3/1993 Mertinooke et al. ..... 427/210
5,674,552 A * 10/1997 Ohira et al. ..... 427/8

FOREIGN PATENT DOCUMENTS

JP 10-99763 * 4/1998

* cited by examiner

*Primary Examiner*—Katherine A. Bareford
(74) *Attorney, Agent, or Firm*—Bierman, Muserlian and Lucas

(57) ABSTRACT

A coating method of coating an outer circumferential surface of a cylindrical base with a coater having a supply port, a coating solution chamber, and a slit communicating with the coating solution chamber, the slit being provided around an inner circumferential surface of the coater, comprisse steps of: feeding a coating solution from the supply port to the coating solution chamber so that the coating solution is discharged to the slit; adjusting an absolute pressure P in the coating solution chamber so as to satisfy the following formula: $3\times10^4 \leqq P \leqq 3\times10^6$ ($mmH_2O$) and relatively moving the cylindrical base through a hole formed by the inner circumferential surface of the coater so that an outer circumferential surface of the cylindrical base is uniformely coated with the coating solution flowing out from the slit.

4 Claims, 11 Drawing Sheets

COATING METHOD FOR CYLINDRICAL BASE MEMBER

BACKGROUND OF THE INVENTION

The present invention relates to a coating method and a coating apparatus with which a coating solution fed through a supply port from the outside is distributed to a coating solution reservoir chamber and the distributed coating solution is fed through a slit toward the side of a internal circumferential surface and is coated on the outer circumferential surface of a cylindrical base member moving relative to the coating apparatus, in particular, to a coating method and a coating apparatus with which a coating solution is coated uniformly on an external circumferential surface of a cylindrical base material having a continuous surface formed endlessly. This type of the coating apparatus is preferably used as the coating apparatus to coat a coating solution containing a light sensitive material at the time of manufacturing a photoreceptor drum for use in an electrophotographic type image forming apparatus.

With regard to a method of coating a thin layer uniformly on an external circumferential surface of a cylindrical base material, there have been studied various methods such as a spray coating method, a dip coating method, a blade coating method and a roll coating method. In particular, for the coating of a uniform and thin layer such as that on an electrophotographic photoreceptor drum, development of a coating apparatus which is excellent to be manufactured is now studied. However, in a conventional coating apparatus an coating method for a cylindrical base material having a endlessly formed continuous surface, there are week points that an even coating layer could not be obtained and a productivity is not so good.

In the spray coating method, before a drop of coating solution jetted out of a spray gun reaches the external circumferential surface of a cylindrical base material having a continuous surface formed endlessly, a solvent evaporates, and thereby solid body concentration in the drop of a coating solution rises and viscosity of the coating solution is raised accordingly. Therefore, when the drop of a coating solution reaches the surface, the drop of a coating solution does not spread on the surface, or a particle dried and solidified sticks to the surface, resulting in an impossibility of obtaining those having coated surfaces which are excellent in smoothness. Further, the rate of reaching of a drop of a coating solution to a cylindrical base material having a continuous surface is not 100% resulting in a loss of a coating solution, and it is very difficult to control a layer thickness because uniformity is partially poor. In addition, in the case of a highly polymerized solution, cobweb formation is sometimes caused, and there accordingly are restrictions for solvents and resins to be used.

In the blade coating method and roll coating method, a blade or a roll is arranged in the longitudinal direction of a cylindrical base material, for example, so that the cylindrical base material is rotated for coating, and after the cylindrical base material makes one turn, the blade or the roll is retreated. However, when the blade or the roll is retreated, viscosity of a coating solution makes a part of a coated layer to be thicker than other portions, which is a weak point that a uniform layer can not be obtained.

In the dip coating method, smoothness on the surface of a coating solution and poor uniformity of a coated layer as stated above are improved.

However, control of a thickness of a coated layer depends on physical properties of a coating solution such as viscosity, surface tension, density and temperature as well as a coating speed, and therefore, adjustment of physical properties of a coating solution is very important. Further, there are further disadvantages that a coating speed is low and an amount of solution that is not less than a certain level is required for filling a tank for a coating solution. Further weak point is that components of lower layers melt out in the case of multi-layer coating and the tank for a coating solution is easily contaminated accordingly.

Under the background stated above, a ring-shaped amount regulating-type coating apparatus as described in Japanese Patent Publication Open to Public Inspection No. 189061/1983 and No. 60-95440 (hereinafter referred to as Japanese Patent O.P.I Publication) was developed. In this coating apparatus, a coating solution fed through a supply port from the outside is distributed to a ring-shaped coating solution reservoir chamber and the distributed coating solution is fed through a slit toward a internal circumferential surface and is coated uniformly on an external circumferential surface of a cylindrical base material having a continuous surface which is formed endlessly and is moved relative to the coating apparatus. In particular, the extrusion type coater described in a printed copy of the latter Japanese Patent O.P.I Publication is only one capable of coating a high viscosity coating solution onto a cylindrical base member.

This extrusion type coater directly extrudes a coating solution fed into a coating solution distributing chamber (a coating solution reservoir chamber) through a coating solution distributing silt to a coating solution flow-out port so as to form a bead between the cylindrical base member and the coating solution flow-out port, thereby coating continuously.

This extrusion type coater can adjust finely an amount of the coating solution fed through the slit and can coat with a small amount of the coating solution. As a result, the coating solution is not soiled, and the coating capable of being a high productivity and controlling the layer thickness easily can be realized.

However, even in the above coating apparatus, there is a problem that fluctuation in the thickness takes place so as to cause coating irregularities. In particular, in the extrusion type coater described in the latter Japanese Patent O.P.I Publication, the problem that the bead is discontinued occurs when a high viscosity coating solution is used. As result of energetic study, the present inventor found that the above problem has a close relation with the movement of the coating solution in the slit, that is, the absolute pressure in the coating solution distributing chamber.

SUMMARY OF THE INVENTION

The problem to be solved by the present invention is to make the movement of the coating solution in the slit stable and to reduce the coating irregularities. Further, the objective of the present invention is to conduct coating uniformly stably without causing coating failure and coating irregularities and without a long stay of a solution or a vapor in the coating solution distributing chamber.

The above problem can be solved by the following coating method:

A coating method of coating an outer circumferential surface of a cylindrical base with a coater having a supply port, a coating solution chamber, and a slit communicating with the coating solution chamber, the slit being provided around an inner circumferential surface of the coater, comprising steps of:

feeding a coating solution from the supply port to the coating solution chamber so that the coating solution is discharged to the slit;

adjusting an absolute pressure P in the coating solution chamber so as to satisfy the following formula:

$$3\times10^4 \leqq P \leqq 3\times10^6 \ (mmH_2O)$$

and relatively moving the cylindrical base through a hole formed by the inner circumferential surface of the coater so that an outer circumferential surface of the cylindrical base is uniformely coated with the coating solution flowing out from the slit.

The above problem can be solved by the following coating apparatus:

A coating apparatus to coat a coating solution on an outer circumferential surface of a cylindrical base, comprising:

a coater body provided with a supply port, a coating solution chamber, an inner circumferential surface forming a hole through which the cylindrical base passes the coater body, a slit provided around the inner circumferential surface, wherein the supply port, the coating solution chamber, and the slit are communicated so as to flow the coating solution;

a feeding means for feeding the coating solution from the supply port into the coating solution chamber so that an absolute pressure P in the coating solution chamber is adjusted to satisfy the following formula and the coating solution is distributed from the coating solution chamber to the slit:

$$3\times10^4 \leqq P \leqq 3\times10^6 \ (mmH_2O)$$

a moving means for relatively moving the cylindrical base so as to pass through the hole so that an outer circumferential surface of the cylindrical base is coated with the coating solution flowing out from the slit.

Further, the above problem can be solved by the following coating method as the more prefereable method:

In a coating method in which a coating solution fed through a supply port from the outside is distributed to a ring-shaped coating solution reservoir chamber and the distributed coating solution is fed through a slit toward an inner circumferential surface and is coated on the outer circumferential surface of a cylindrical base member moving relative to a coater, the coating method of the present invention is characterized in that the absolute pressure in the coating solution reservoir chamber satisfy the following formula:

$$3\times10^4 \leqq P < 3\times10^6 \ (mmH_2O)$$

In the coating method of the present invention, since the absolute pressure in the solution reservoir chamber satisfy the following formula: $3\times10^4 \leqq P < 3\times10^6$ ($mmH_2O$), the movement of a high viscosity coating solution in the slit becomes stable. Whereby fluctuation in the layer thickness of the coating solution coated on the cylindrical base member can be refrained and coating irregularities can be reduced.

In a coating apparatus comprising a supply port through which a coating solution is fed from the outside, a ring-shaped coating solution reservoir chamber to distribute the coating solution fed through the supply port in the form of a ring, and a ring-shaped slit to feed the coating solution from the coating solution reservoir chamber toward an inner circumferential surface, the coating solution fed through the slit is coated on an outer circumferential surface of the cylindrical base member moving relative to the coating apparatus, the coating apparatus of the present invention is characterized in that the absolute pressure in the solution reservoir chamber satisfies the following formula:

$$3\times10^4 \leqq P \leqq 3\times_{10}{}^6 \ (mmH_2O)$$

In the present invention, "absolute pressure" means a gage pressure.

Further, in a coating method in which a coating solution fed through a supply port from the outside is distributed to a ring-shaped coating solution reservoir chamber and the distributed coating solution is fed through a slit toward so as to be coated on the outer circumferential surface of a cylindrical base member, the coating method of the present invention is characterized in that the coating solution fed through the supply port is fed to the bottom portion in the coating solution reservoir chamber having a cross sectional shape formed by a curve, and the coating solution in the coating solution reservoir chamber is pressed to be fed through the slit toward an inner circumferential surface and is coated on the outer circumferential surface of the cylindrical base member moving relative to the coater.

Further, in a coating apparatus surrounding around a cylindrical base member moving in its longitudinal direction and comprising therein a ring-shaped coating solution reservoir chamber, a supply port through which a coating solution is fed from the outside to the coating solution reservoir chamber and a slit to form a conduit on an inner section from the coating solution reservoir chamber, the coating apparatus of the present invention is characterized in that the inlet section of the supply port is located at a bottom portion in the coating solution reservoir chamber and the cross section of the coating solution reservoir chamber is formed by a curve.

The coating method used in the present invention can be applicable to a simultaneous multi-layer coating method and a successive multi-layer coating depicted in FIG. 1 and FIG. 2 in the printed copy of Japanese Patent O.P.I Publication No. 60-95440.

DETAILED DESCRIPTION OF THE PREFERRED EMBODIMENT

Figure 1:
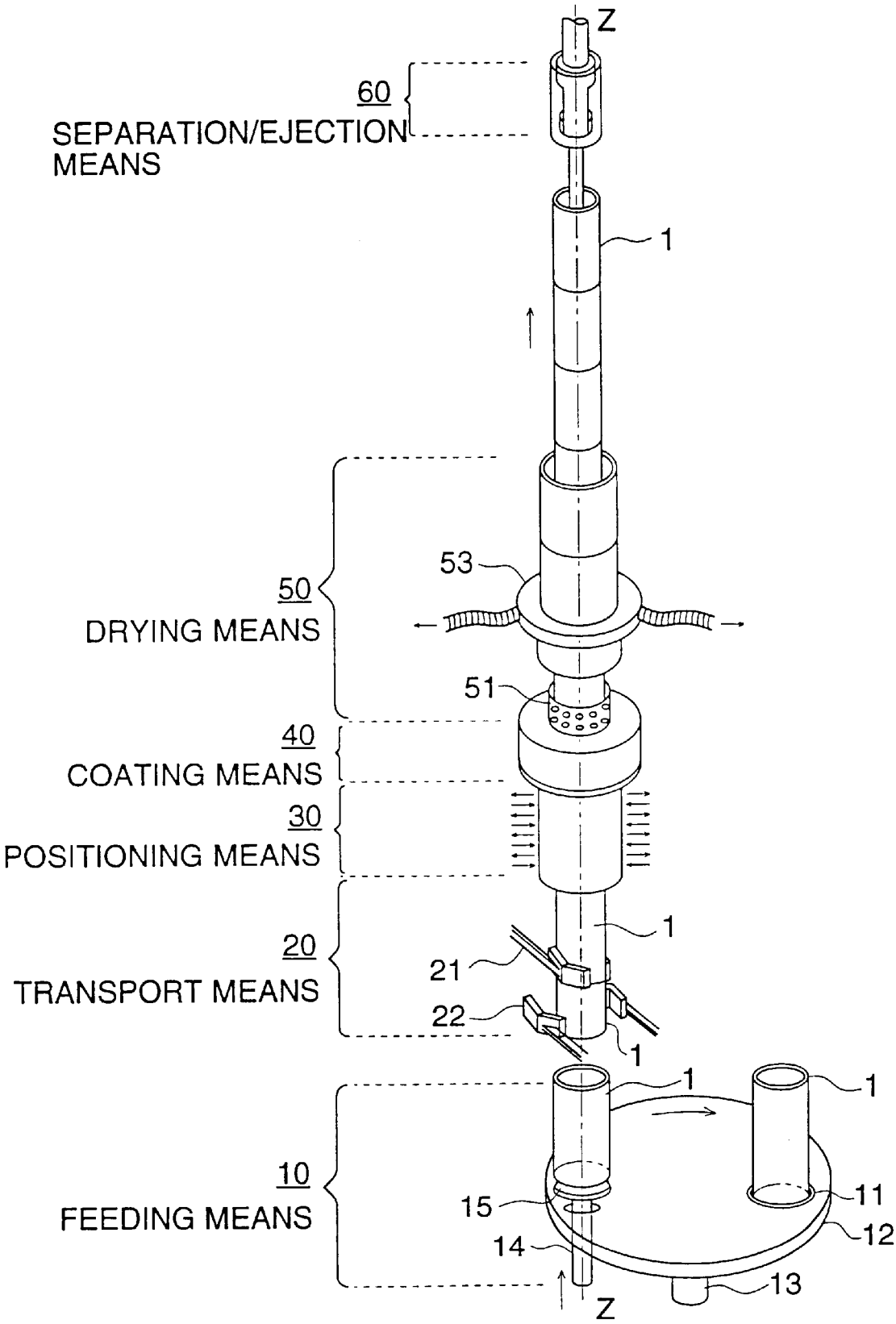
FIG. 1 is a perspective view showing the entire structure of a continuous coating apparatus of the present invention.

Hereinafter, an embodiment of the present invention is explained with reference to the drawings. FIG. 1 is a perspective view showing a total construction of a continuous coating apparatus of the invention.

In FIG. 1, the numerical 10 is a feeding means which feeds cylindrical base material 1 to a predetermined position just under a coating means and then pushes it up, 20 is a transport means that holds an outer circumferential surface of the cylindrical base material 1 fed for stacking cylindrical base materials after aligning the cylindrical axes thereof and pushes them upward vertically from the bottom, 30 is a positioning means which positions the aforementioned cylindrical base material 1 to the center of a ring-shaped coating section of the coating apparatus, 40 is a coating means that coats a coating solution continuously on the outer circumferential surface of the cylindrical base material 1, 50 is a drying means that dries the coating solution coated on the cylindrical base material 1, and 60 is a separation/ejection means that separates plural stacked cylindrical base materials which are dried and transported vertically and takes them one by one to eject.

The continuous coating apparatus of the invention is of a constitution wherein the above-mentioned means are arranged continuously on vertical center line Z—Z, and it can accomplish highly accurate full-automatic production requiring no manual labor. Namely, the above-mentioned feeding means 10 is composed of turn table 12 equipped with a plurality of mounting means 11 on each of which the cylindrical base material 1 is placed, driving means 13 that rotates the turn table 12 to feed into a vertical line leading to the transport means 20, elevating means 14 that pushes up the cylindrical base material 1 which has already been held and transported upward by the transport means 20 so that is can be stacked, hand means 15 which is provided on the upper end of the elevating means 14 for feeding the cylindrical base material, and an unillustrated control means that controls the timing for the driving means 13 to rotate and for the elevating means 14 to push up. Incidentally, feeding of the cylindrical base material 1 onto the turn table 12 is conducted by a robot handle.

The transport means 20 provided above the feeding means 10 is equipped with two paired holding means 21 and 22 which can be brought in pressure contact with and released from an outer circumferential surface of the cylindrical base material 1 and can move vertically, thus it has functions for positioning and holding the cylindrical base material 1 and transporting it upward. Details of the above-mentioned means 20, 30, 40, 50 and 60 will be stated later.

Figure 2:
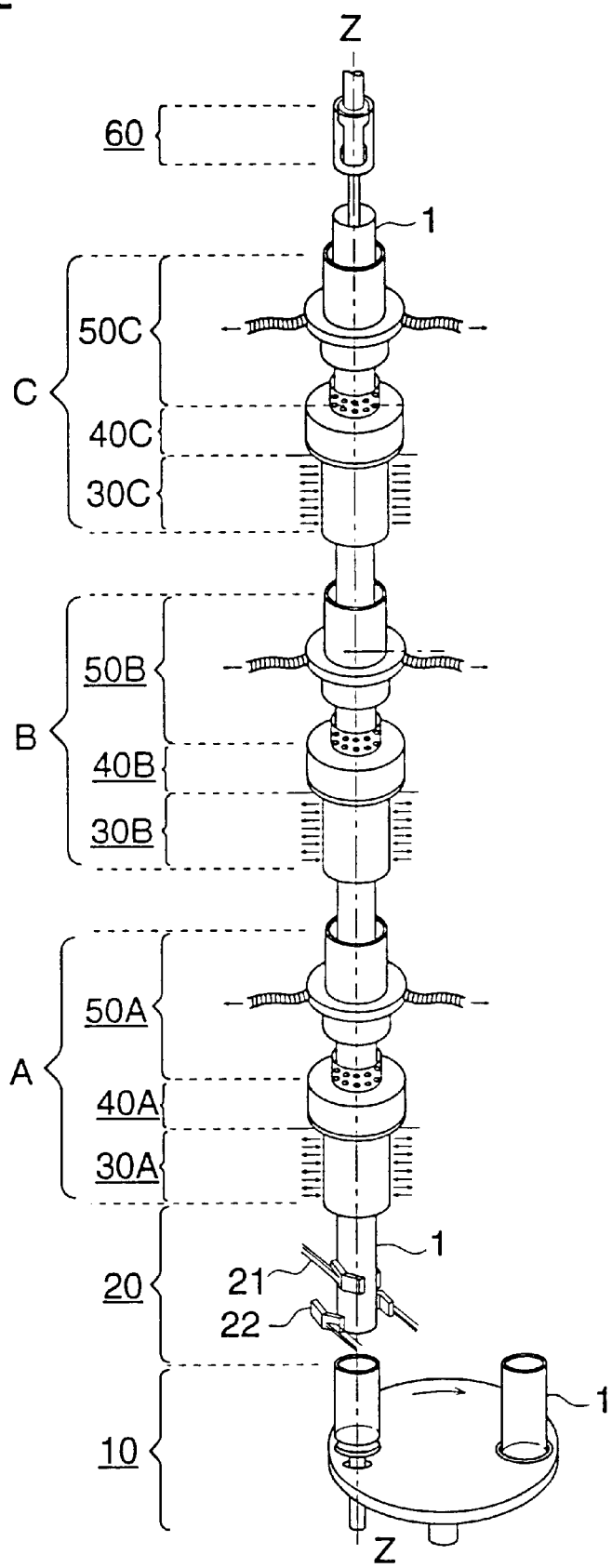
FIG. 2 is a perspective view showing another example of the continuous coating apparatus of the present invention.

FIG. 2 is a perspective view showing a stepwise and continual coating apparatus that is another example of the invention. On the vertical center line Z—Z above the aforesaid transport means 20 in this example, there are vertically arranged plural sets of unit UA composed of positioning means 30A, coating means 40A and drying means 50A, unit UB composed of positioning means 30B, coating means 40B and drying means 50B, and unit UC composed of positioning means 30C, coating means 40C and drying means 50C. On the uppermost step, there is provided the aforesaid separation/ejection means 60. Coating solutions jetted respectively from coating means 40A, 40B and 40C form multiple coated layers on the cylindrical base material 1 stepwise which are dried respectively by drying means 50A, 50B and 50C, then, cylindrical base material 1A located in the upper most position is held by the separation/ejection means 60 and is separated from the lower cylindrical base material 1B to be placed on a pallet outside the apparatus.

FIGS. 3 to 7 are views showing an embodiment of coating means 40 of the present invention.

Figure 3:
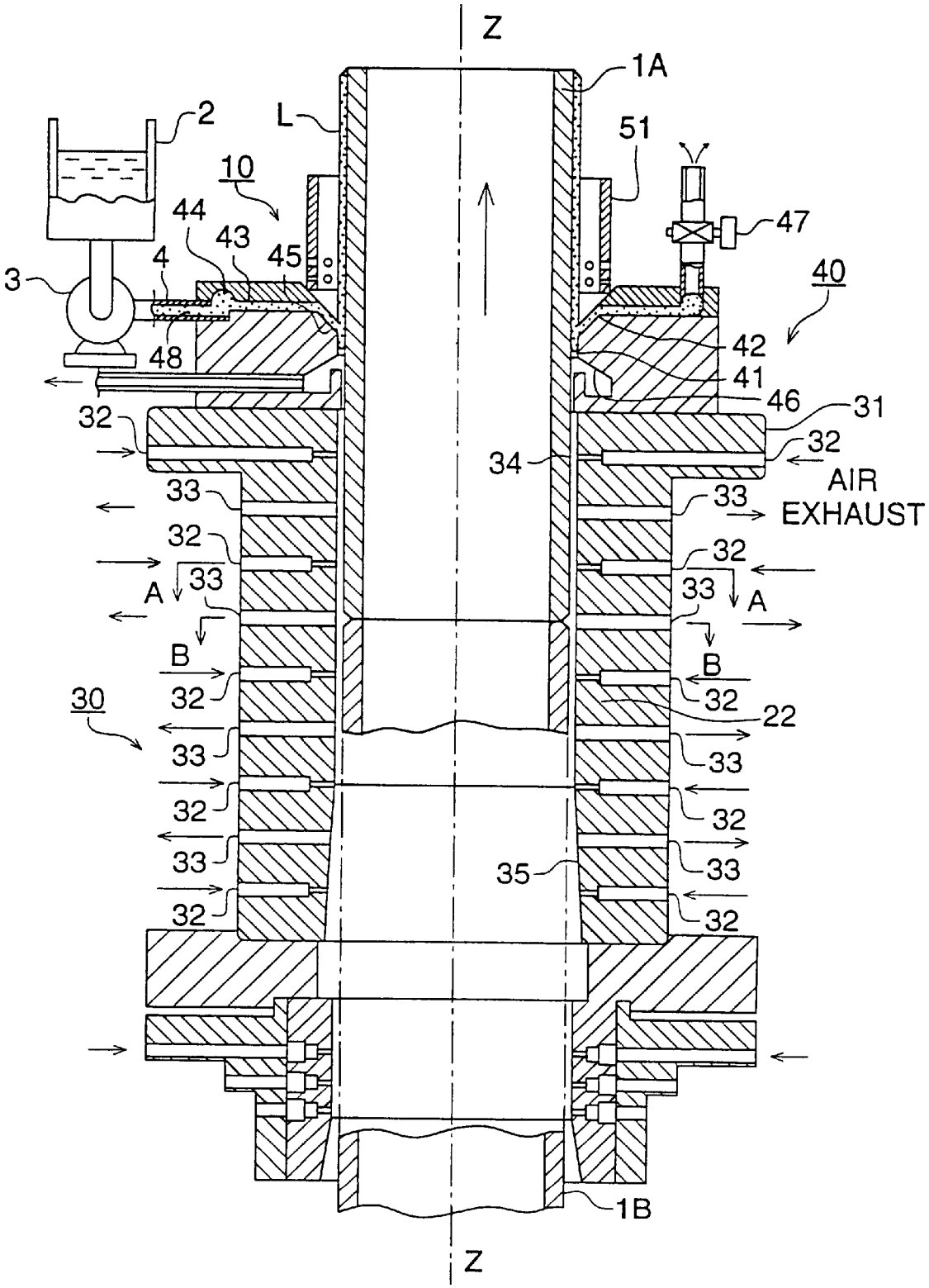
FIG. 3 is a sectional view showing positioning means and a slide hopper type coating means.
Figure 4:
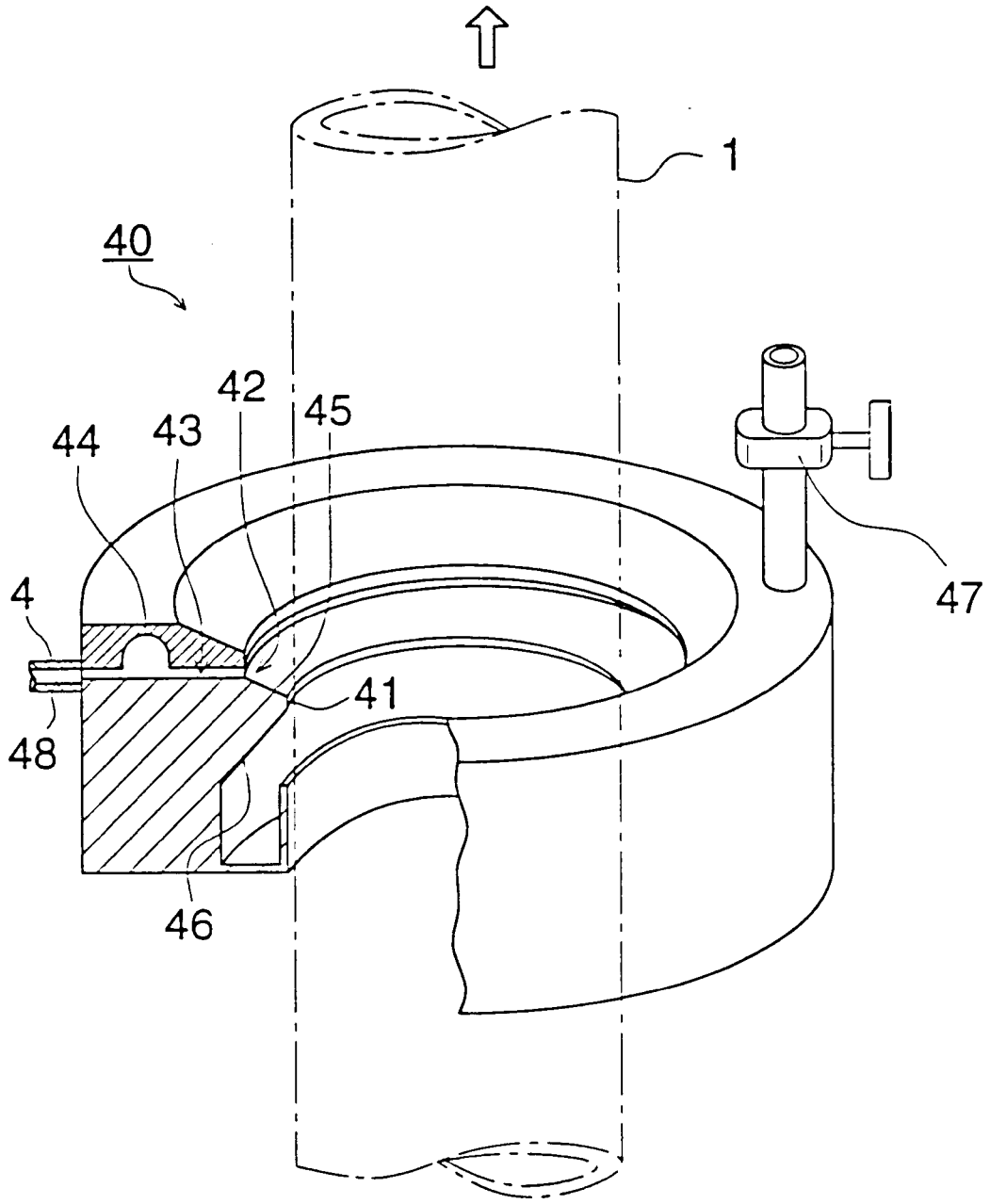
FIG. 4 is a perspective view of the slide hopper type coating means mentioned above.

FIG. 3 is a sectional view showing positioning means 30 and coating means 40, while FIG. 4 is a perspective view of the coating means 40.

A plurality of cylindrical base materials 1A and 1B (hereinafter referred to as cylindrical base materials 1) stacked vertically along vertical center line Z—Z as shown in FIG. 3 are moved upward continuously in the arrowed direction, and a coating solution (light-sensitive solution) L is coated on the outer circumferential surface of the cylindrical base materials 1 by portion (hopper coating surface) 41 related directly to coating in coating apparatus of a slide hopper type 40 surrounding the cylindrical base material. Incidentally, as cylindrical base material 1, a hollow drum such as, for example, an aluminum drum or a plastic drum, or a base material of a seamless belt type may also be used.

On the hopper coating surface 41 mentioned above, there is formed horizontally narrow coating solution distributing slit (hereinafter referred to simply as a slit) 43 having coating solution flow out port 42 that is opened toward the cylindrical base material 1. This slit 43 is communicated with ring-shaped coating solution distributing chamber (coating solution reservoir chamber) 44, and coating solution L in reservoir tank 2 is supplied by force feeding pump 3 to the ring-shaped coating solution distributing chamber 44 through supply pipe 4 after being introduced from supply port 48.

The coating solution L fed from the supply port 48 is fed to the bottom portion in the coating solution distributing chamber (or the coating solution reservoir chamber) 44 having a cross section formed by a curve, for example, a circular cross sectional shape. The coating solution in the coating solution distributing chamber 44 is fed toward a slit 43 by a compressing pump 3.

The cross sectional shape of the coating solution distributing chamber 44 is not limited to the above circular cross sectional shape. The cross sectional shape includes all shape formed by a smooth curve without having any small corner. For example, an oval, an elongated circle or an egg shape whose circle ratio is 0.8 to 1.2 may be used. Since the coating solution distributing chamber 44 composed of such an almost curved cross sectional shape has not any space in which the coating solution stays for a long time in its chamber, even when a dispersed solution or a high viscosity coating solution is coated on a cylindrical base member 1, uniform coating can be maintained during the coating period from an initial coating to the coating for several ten thousand-th cylindrical base member, indicating the supreme effect in stability.

On the other hand, under the coating solution flow out port 42 of the slit 43, there is formed coating solution sliding surface (hereinafter referred to as a sliding surface) 45 that is inclined downward continuously and is formed so that a diameter of its end portion is slightly greater than the outside diameter of the cylindrical base material 1. There is further formed lip-shaped section 46 that extends downward beyond the end portion of the sliding surface 45. In the course of coating by means of such coating means (coating apparatus of a slide hopper type) 40, when coating solution L is pushed out from the slit 43 and is caused to flow down along the sliding surface 45 in the course of drawing up the cylindrical base material 1, the coating solution arriving at the end portion of the sliding surface 45 forms a bead between the end portion of the sliding surface 45 and the external circumferential surface of the cylindrical base material 1, and then is coated on the surface of the cylindrical base material 1. Since the end portion of the sliding surface 45 and the cylindrical base material 1 are arranged to have a clearance between them, the cylindrical base material 1 is not damaged in the course of coating, and even when many layers each differing in nature from others are formed, layers already coated are not damaged.

On the other hand, on a part of the coating solution distributing chamber 44 located at the furthermost position from a coating solution supply section of the aforementioned force feeding pump 3, there is provided air escape means 47 for extracting bubbles in the coating solution distributing chamber 44. When coating solution L in the reservoir tank 2 is supplied to the coating solution distributing chamber 44 and is further supplied to the coating solution flow out port 42 from the coating solution distributing slit 43, an opening/closing valve is opened so that air in the coating solution distributing chamber 44 may be extracted by the air escape means 47.

As shown in FIG. 3, under the coating means 40 mentioned above, there is affixed positioning means 30 which positions a cylindrical base material in its circumferential direction. On positioning means main body 31 of the positioning means 30 for the cylindrical base material 1, there are formed a plurality of air inlets 32 and a plurality of air outlets 33. These plural air inlets 32 are connected to an unillustrated air supply pump to force-feed a fluid such as air. An end of each air inlet 32 positioned on the side facing the external circumferential surface ice of the cylindrical base material 1 is connected to orifice 34. The orifice 34 faces the external circumferential surface of the cylindrical base material 1 while keeping a predetermined clearance between them. The clearance is 20 $\mu$m–3 mm, and preferably is 30 $\mu$m–2 mm. When this clearance is smaller than 20 $\mu$m, even a small deviation of cylindrical base material 1 makes itself to come into contact with an inner wall of main body 31, so that the cylindrical base material tends to be damaged. When the clearance is greater than 3 mm, accuracy of positioning cylindrical base material 1 is lowered. The orifice 34 mentioned above is a nozzle with a small diameter of 0.01–1.0 mm, and its diameter is preferably 0.05–0.5 mm.

An internal circumferential surface at the bottom of an inner wall of the positioning means main body 31 is formed to be tapered surface 35 whose inlet side is greater in diameter. This tapered surface 35 is a conical surface whose length in its axial direction is, for example, 50 mm and its inclination angle at one side is 0.5 mm. Due to this tapered surface provided, a tip portion of the cylindrical base material 1 is prevented from touching an inner circumferential surface of the inner wall when the cylindrical base material 1 enters the inner wall of the main body 31.

A fluid that is force-fed from the air supply pump is introduced to the inside of the positioning means main body 31 from a plurality of air inlets 32, and then is jetted from a plurality of orifices 34 to form a uniform fluid layer together with the external circumferential surface of the cylindrical base material 1A (1B). The fluid after being jetted is ejected out of an apparatus through a plurality of air outlets 33.

A diameter of an opening of the aforesaid orifice 34 is 0.01–1 mm and preferably is 0.05–0.5 mm, and for example, it is formed to be a circle of 0.2–0.5 mm. An opening of the air outlet 33 is 1.0–10 mm, preferably is 2.0–8.0 mm, and it is formed to be a circle with a diameter of 3–5 mm, for example.

A preferable fluid to be supplied to the air inlet 32 is air and an inert gas such as nitrogen gas. The fluid is preferably clean gas ranked at class 100 or higher in JIS.

Incidentally, as a vertical coating apparatus connected to the positioning means of the invention, various apparatuses such as those of a slide hopper type, an extrusion type and a ring coater type are used.

Above the aforementioned coating means 40, there is provided drying means 50 composed of drier hood 51 and drier 53.

Figure 5:
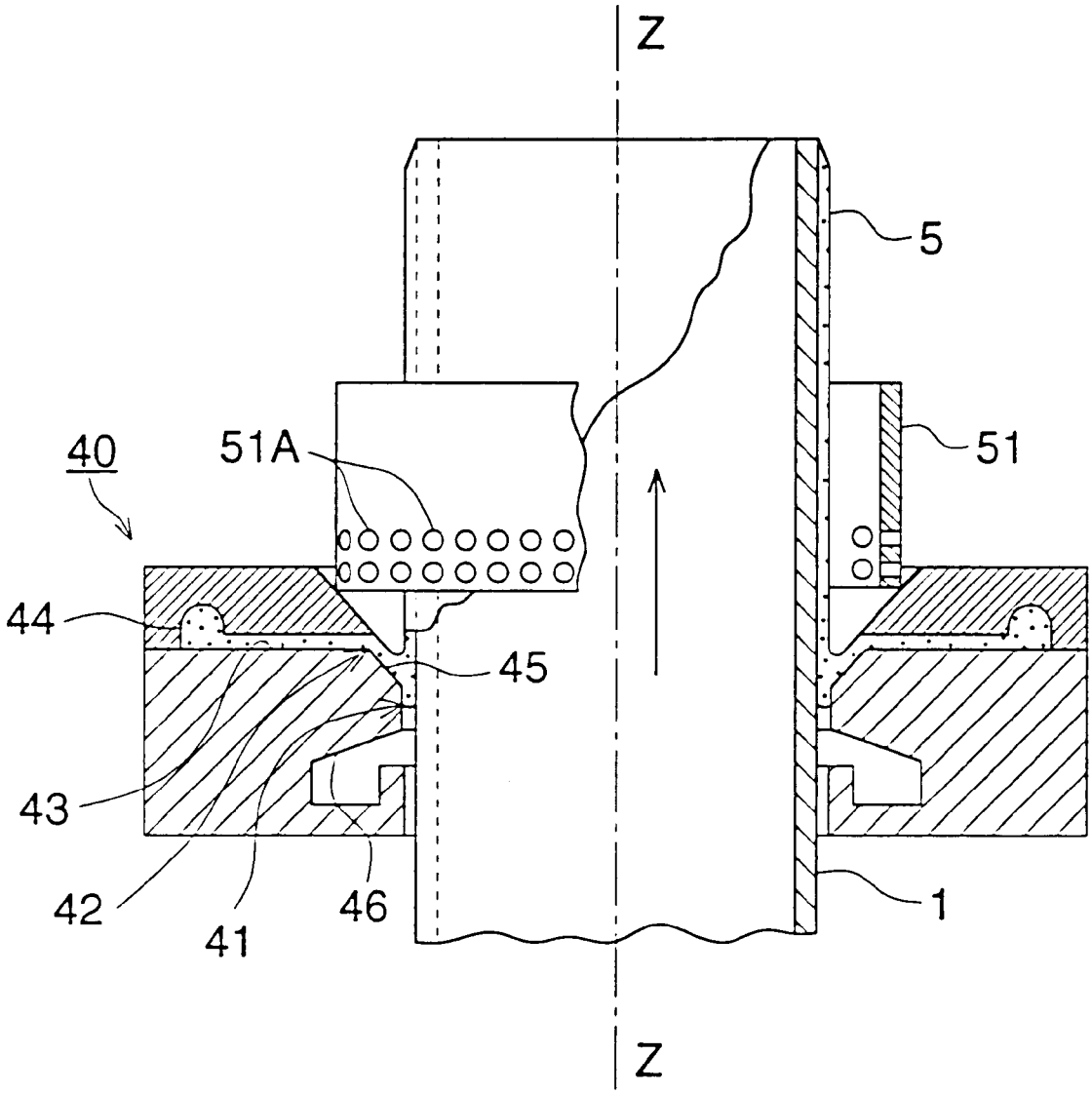
FIG. 5 is a sectional view showing aforesaid slide hopper type coating means and a drying hood.

FIG. 5 is a sectional view of the drying means 40 and the drier hood 51 provided above the drying means 40. The drier hood 51 has a ring-shaped wall surface on which a large number of openings 51A are formed. While the cylindrical base material 1 is raised in the arrowed direction, coating solution L is coated by hopper coating surface (coating head) 41 of the coating means 40, and thereby light-sensitive layer 5 is formed. The light-sensitive layer 5 formed on the cylindrical base material 1 passes through the inside of the drier hood 51 to be dried gradually. This drying is attained when solvents contained in the coating solution L are discharged out of the wall surface through the aforesaid numerous openings 51A. The light-sensitive layer 5 formed by coating solution L on the cylindrical base material 1 with coating means 40 is surrounded, immediately after coating, by the drier hood 51, and solvents are discharged through only openings 51A. Therefore, the speed of drying the light-sensitive layer 5 immediately after coating is mostly proportional to the total area of the openings 51A.

Figure 6:
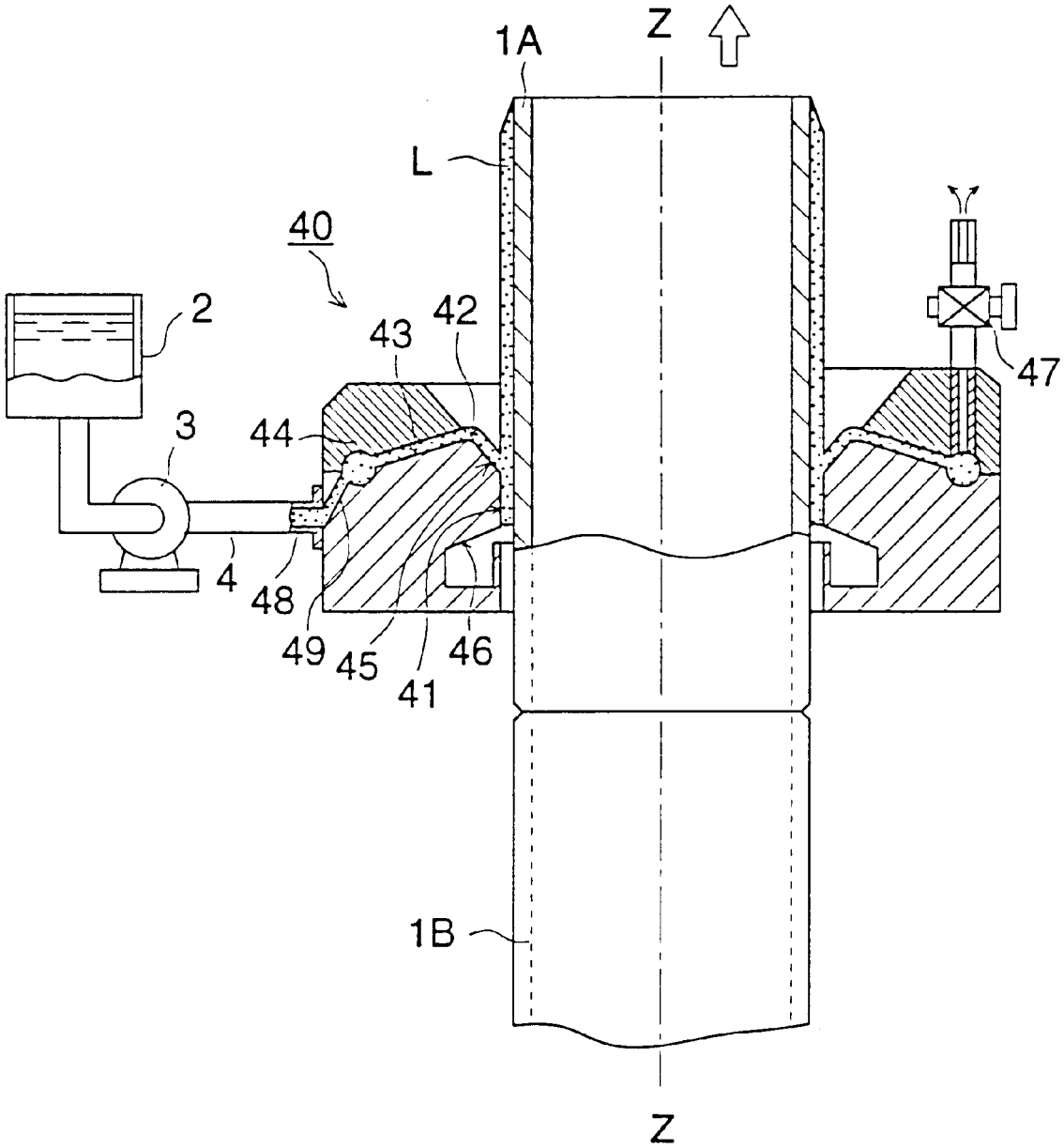
FIG. 6 is a sectional view showing another embodiment of the slide hopper type coating means.

FIG. 6 is a sectional view showing another embodiment of coating means 40 according to the present invention.

In FIG. 6, slit 43 connecting a peak section of a slide surface 45, that is, a coating solution flow-out port 42 with a coating solution distributing chamber 44 is formed so as to incline upward from the coating solution distributing chamber 44 with an inclination angle to the horizontal surface. The inclination angle of the slit 43 is 10 to 80 degrees. If the inclination angle of the slit 43 is smaller than 10 degrees, the effect against fluctuation in pulsation becomes appreciably small. On the other hand, if the inclination angle of the slit 43 is larger than 80 degrees, wave formation of the coating solution on the hopper coating surface 41 becomes so larger that fluctuation in layer thickness becomes larger. On considering the property of the coating solution and the feeding condition for the coating solution, it may be preferable that the inclination angle is 20 to 70 degrees. The coating solution L introduced through the supply port 48 is fed to the coating solution distributing chamber 44 along a feeding passage 49.

The coating solution fed from the supply port 48 to the feeding passage is fed to the bottom section (the lowest section) in the coating solution distributing chamber 44 having a cross sectional shape formed by a curve. The coating solution in the coating solution distributing chamber 44 is pressed and sent through the slit 43 upward toward the inner circumferential surface and then the coating solution is discharged from the coating solution flow-out port 42, flows down on the slide surface 45 and is coated at the hopper coating surface 41 onto the outer circumferential surface of a cylindrical base member moving relative to the coater.

Figure 7:
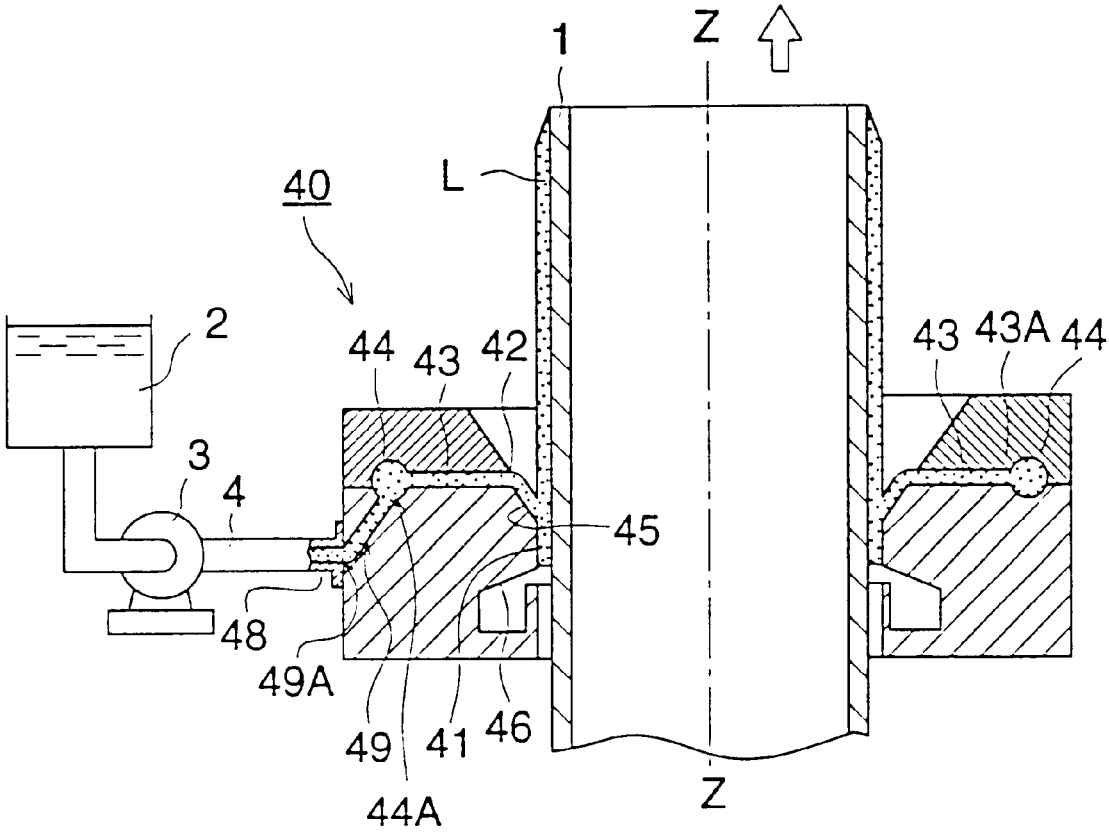
FIG. 7 is a sectional view showing still another embodiment of the slide hopper type coating means.

FIG. 7 is a sectional view showing still another embodiment of the slide hopper type coating means 40.

In FIG. 7, an inlet section of the feeding passage 49 to the coating solution distributing chamber 44 is positioned at the bottom portion in the coating solution distributing chamber 44. That is, the bottom section 49A in the inside diameter of the pipe at the inlet section of the feeding passage 49 is arranged to be on the same horizontal surface or lower than that of the bottom section 44A of the coating solution distributing chamber 44. Owing to this arrangement, the fluctuation in pulsation which tends to take place at the time of sending the solution can be eliminated, the irregularities in layer thickness can be reduced. As a result, the occurrence of the irregularities in image density level at the time of copying a lot of sheets can be avoided.

Figure 8:
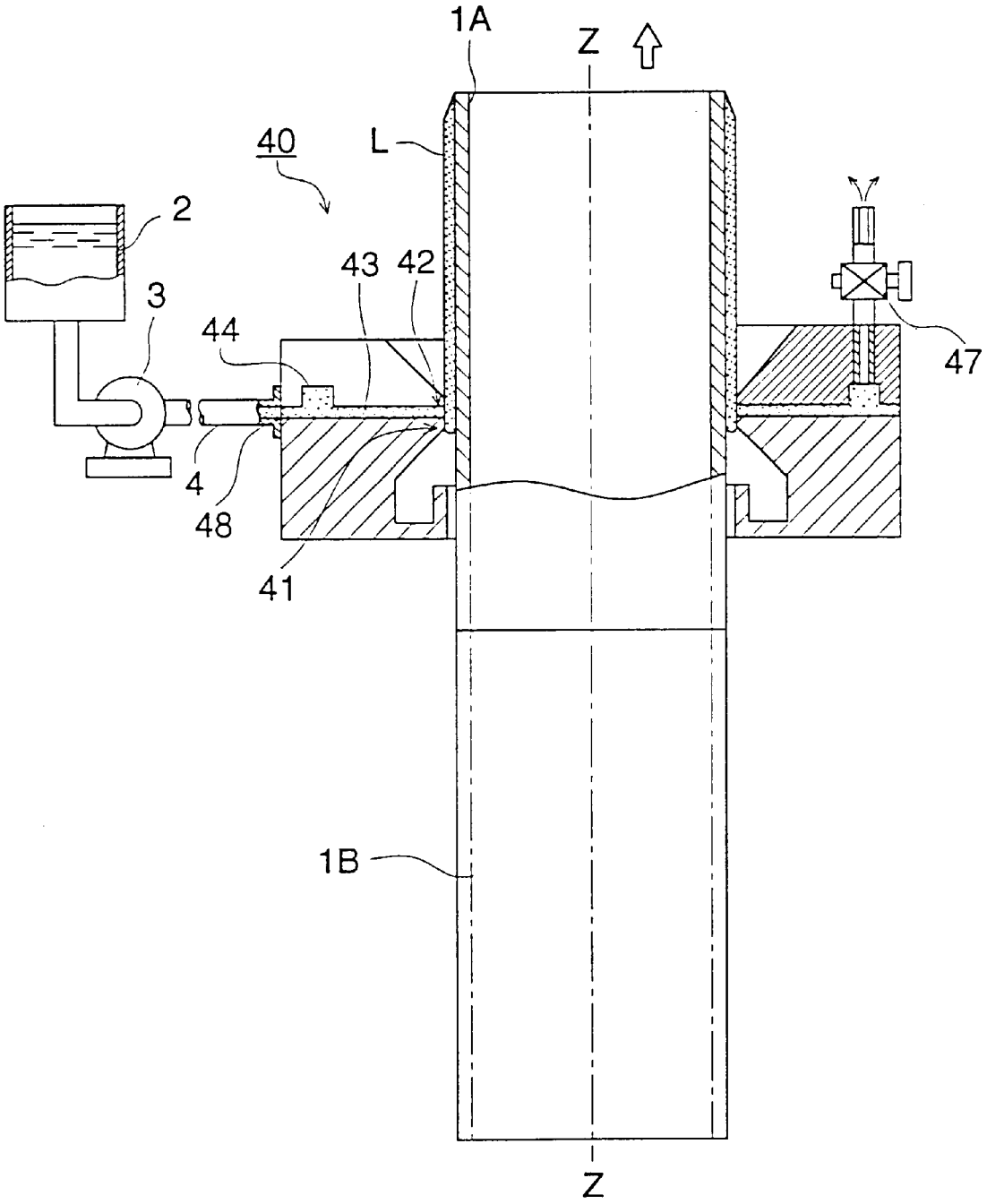
FIG. 8 is a sectional view showing an example of an extrusion type coating means of the present invention.
Figure 9:
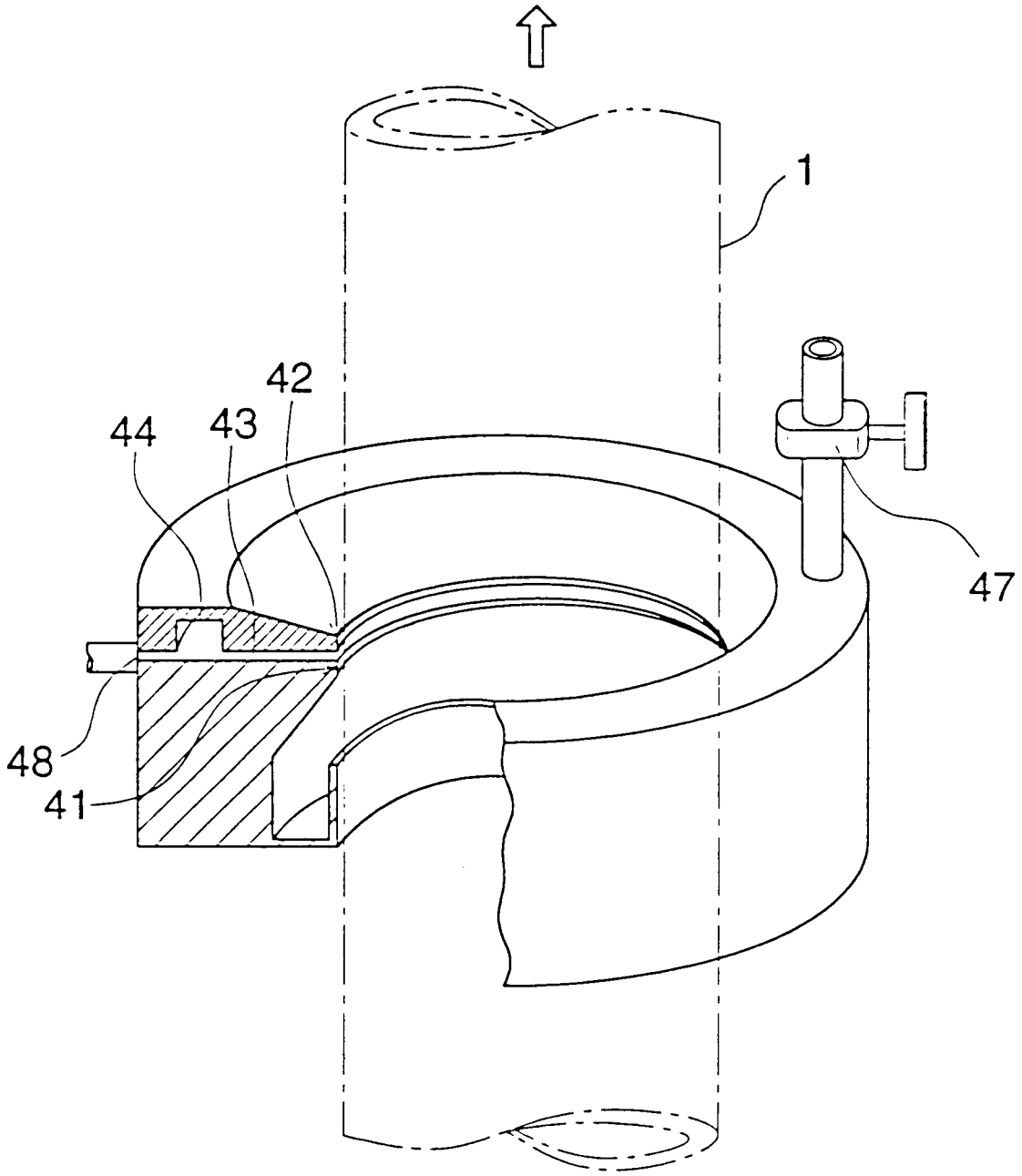
FIG. 9 is a perspective view showing an example of an extrusion type coating means.
Figure 10:
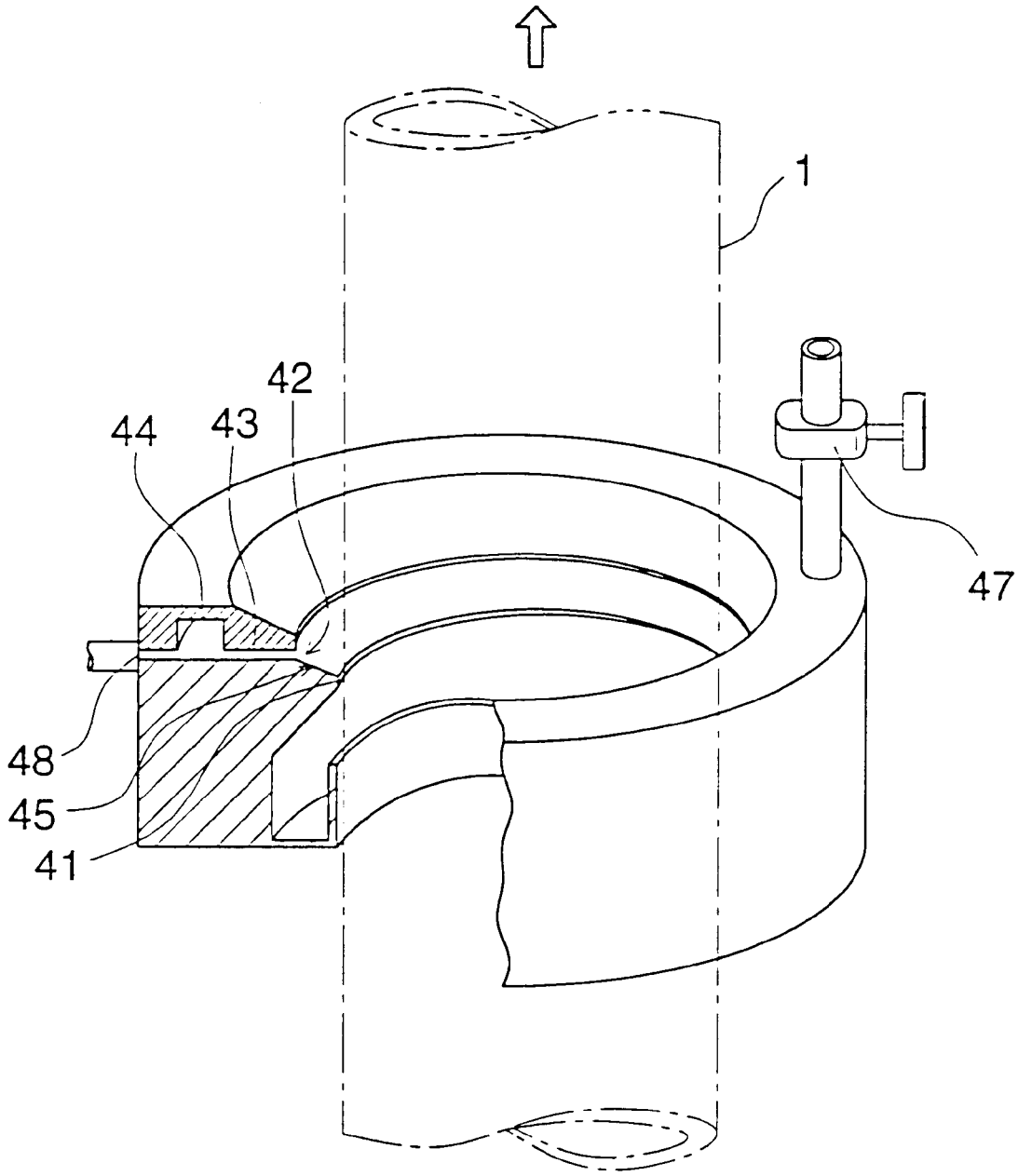
FIG. 10 is a sectional view showing still another example of the slide hopper type coating means of the invention.

FIG. 8 to FIG. 10 are views showing an embodiment of an extrusion type coating means by the present invention.

FIG. 8 is a sectional view of the extrusion type coating means by the present invention. FIG. 9 is a perspective view of it. Incidentally, with regard to reference sign used in these figures, parts having the same function in FIG. 3 to FIG. 5 are provided with the same reference sign. Hereinafter, points different from the beforementioned embodiment are explained.

The extrusion type coating means in the present invention has not the slide surface, extrudes the coating solution fed to the coating solution distributing chamber 44 through the coating solution distributing slit 43 to the coating solution flow-out port 42, forms bead between the coating solution flow-out port 42 and the outer circumferential surface of the cylindrical base member 1 and conducts coating continuously.

As shown in FIG. 8, the cylindrical base members 1A, 1B are superimposed vertically along the center line Z—Z and are continuously shifted upward as indicated with an arrow mark. It may be preferable that a shifting speed is 3 mm/sec or higher and 30 mm/sec or lower. A coating section 41 (or referred as a coating head) surrounds around the cylindrical base members 1A, 1B and coats the coating solution on a outer circumferential surface of the cylindrical base member 1. Here, as the cylindrical base member 1, a hollow drum, such as a aluminum drum or a plastic drum may used. In addition, a seamless belt type base member may be used.

On the other hand, the coating solution L is stored in a storage tank 2 and is fed through a feeding port by a force feed pump 3. The coating solution L fed through the feeding port 48 is distributed by a ring-shaped coating solution distributing chamber 44. The coating solution distributing chamber 44 is arranged coaxially with the center line Z—Z and distributes the fed coating solution in the form of a ring all over the circumference. The coating solution L distributed by the coating solution distributing chamber 44 is extruded through the slit 43 so as to be fed toward the cylindrical base member 1 at the inner circumference of the coating head 41. The slit 43 communicates with the ring-shaped coating solution distributing chamber 44 having coating solution flow-out ports 42 provided all over the cylindrical base member 1. The predetermined gap of preferably 30 $\mu$m to 100 $\mu$m is formed in the horizontal direction between the slit and the cylindrical base member 1.

On the coating head 41, the coating solution L extruded and fed through the slit 43 comes in contact with the outer circumferential surface of the cylindrical base member 1A moving upward and forms a bead, thereby being coated on the outer circumferential surface of the cylindrical base member 1A.

The coating head (coater edge section) at the coating solution flow-out port 42 is shaped to have a size slightly larger than the outer diameter of the cylindrical base member 1.

Since the coating head 41 and the cylindrical base member 1 are arranged with a gap of 30 $\mu$m to 1000 $\mu$m therebetween, the coating can be conducted without damaging the cylindrical base member 1, or without damaging the coated layer on the cylindrical base member 1 in the case that multiple layers differing in nature are formed.

On the other hand, an air vent means 47 is provided to pass through toward the outside from the coating solution distributing chamber 44 so that air is extracted from a part of the coating solution distributing chamber 44 at the farthest point from the feeding port 48. In addition, an open close valve is provided to a part of the air vent means 47. When feeding the coating solution L is started, the air vent means exhausts air from the coating solution distributing chamber 44 by open the open close valve. When the coating solution L is coated on the cylindrical base member 1, the open close valve is closed.

FIG. 10 is a perspective view showing a slide hopper type coating apparatus in which the coating solution extruded from the coating solution flow-out port 42 flows down on the slide surface 45 and is discharged onto the outer circumferential surface of the cylindrical base member 1.

In each coating apparatus mentioned above, when the absolute pressure P in the coating solution distributing chamber 44 is adjusted to be in the range of $3\times10^4 \leqq P \leqq 3\times10^{\&}$, the behavior of the coating solution in the slit 43 becomes stable and the fluctuation in layer thickness of the coating solution coated on the cylindrical base member 1 is suppressed, thereby reducing the coating irregularities. In particular, this is more effective for a high viscosity coating solution, preferably, for a coating solution having a viscosity of 500 to 10000 millipascal-sec. If the absolute pressure is lower than $3\times10^4$ ($mmH_2O$), the coating solution flowed out from the slit 43 contains the numerous amount of the fluctuation component and the uniform coating layer could not be formed. On the other hand, if the absolute pressure is higher than $3\times10^6$ ($mmH_2O$), the coating solution flowing in the slit 43 forms a turbulent flow. As a result, the uniform coating layer could not be formed. Further, it may be more preferable that the absolute pressure P satisfies the formula of $5\times10^4 \leqq P \leqq 1\times10^6$ ($mmH_2O$), because the irregularities can be reduced much more.

Here, "absolute pressure" is a gage pressure. For measuring this pressure, it can be measured directly by inserting the measuring terminal in the coating solution distributing chamber 44. In the abovementioned embodiment, the absolute pressure P in the coating solution distributing chamber 44 is measured by inserting the measuring terminal in a hole for the air vent means 47. The absolute pressure P can be adjusted by varying the values of main factors of the viscosity of the coating solution, the gap of the slit 43, and the flow quantity of the coating solution.

Further, in the coating method and the coating apparatus of the present embodiment, since the coating solution flow-out port 42 and the cylindrical base member 1 are arranged so as to form a gap therebetween so that the coating can be conducted without damaging the cylindrical base member 1, or also without damaging a layer having already been coated in the case that multi-layers differing in nature are formed. Further, in the case that multi-layers which are different in nature and are solved in the same solvent, since the time period that coating materials exist in the solvent is too short in comparison with that in the dip coating method, the lower layer coating material hardly solve out in the upper layer or in the layer having already been coated.

Figure 11:
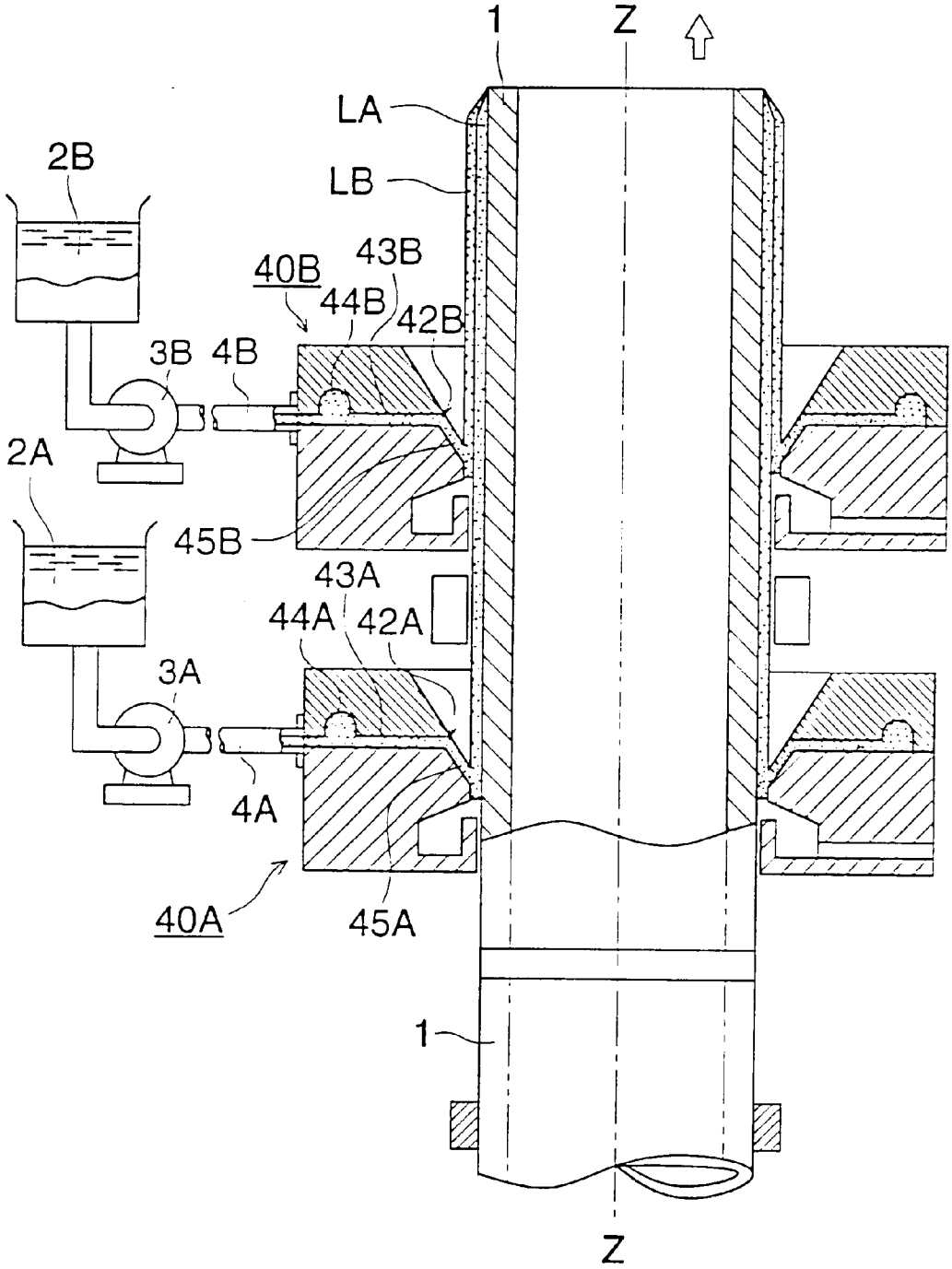
FIG. 11 is a sectional view showing an example of a successive multi-layer coating apparatus.

FIG. 11 is a sectional view showing one example of the successive multi-layer coating apparatus of the present invention in which the coating apparatus 40 shown in FIG. 3 is arranged on the upper section and the lower section.

A slit 43A formed in the horizontal direction in the coating apparatus 40A communicates with a ring-shaped coating solution distribution chamber 44A in which a coating solution LA in a storage tank 2A is fed by a force feed pump 3A through a feeding pipe 4A.

The coating solution LA extruded from the coating solution flow-out port 42A of the slit 43A flows down along the slide surface 45A. When the coating solution LA comes at the end of the slide surface 45A, the coating solution forms a bead between the end of the slide surface 45A and the outer surface of the cylindrical base member 1, whereby the coating solution is coated on the outer surface of the cylindrical base member 1.

The coating apparatus 40B arranged vertically above the coating apparatus 40B has the same configuration of the coating apparatus 40A.

A slit 43B formed in the horizontal direction in the coating apparatus 40B communicates with a ring-shaped coating solution distribution chamber 44B in which a coating solution LB in a storage tank 2B is fed by a force feed pump 3B through a feeding pipe 4B.

The coating solution LB extruded from the coating solution flow-out port 42B of the slit 43A flows down along the slide surface 45B. When the coating solution LB comes at the end of the slide surface 45B, the coating solution forms a bead between the end of the slide surface 45B and the outer surface of the cylindrical base member 1, whereby the coating solution LB is coated and superimposed on the outer surface of the cylindrical base member 1.

Incidentally, the coating method and the coating apparatus are preferably applied for an electrophotograpic light sensitive drum which is required to have a thin and even coating layer. However, the present invention is not limited to this application. For example, the present invention may be also applicable to the manufacturing of an electrostatic recording medium, the covering on the surface of a roller, the coating on the outer circumferential surface of an endless web-shaped material. In other words, the present invention can be used as a coating method for outer circumferential surface of a cylindrical base member having an endless continuous surface. Further, it may be preferable that the coating apparatus is fixed and the cylindrical base member is moved, preferably moved upwardly. However, it may be not necessary to limit to this embodiment. It may be permissible that the cylindrical base member and the coating apparatus are moved relatively to each other.

The present invention is now explained with the following examples. The following examples are explained in terms of coating the coating material containing light sensitive materials when a light sensitive drum for use in an electrophotographic apparatus. The present invention is not limited to the following examples and is also applicable to the coating for the other possible coating material.

EXAMPLE 1

As a conductive support of a cylindrical base member, a support of a mirror-finished aluminum drum having a diameter of 80 mm and a height of 355 mm was used. Coating was conducted to form the dry layer thickness of 0.5 $\mu$m on the aforesaid cylindrical base member by the use of the coating apparatus of the slide hopper type as shown in FIG. 10 after coating solution composition UCL-1 as shown below was prepared. UCL-1 coating solution composition (3% polymer concentration)

Copolymer nylon resin (CM-8000, made by Toray)

Methanol/n-butanol=10/1 (ratio by volume)

Next, coating was further conducted to form the dry layer thickness of 0.3 $\mu$m on the aforesaid UCL-1 by the use of the coating apparatus of the slide hopper type as shown in FIG. 10 after coating solution composition CGL-1 as shown below was prepared.

CGL-1 Coating Solution Composition (Solid Component Concentration 3.0%)

Fluorenone type disazo pigment (CGM-1)

Butyral resin (Eslec BX-L, made by Sekisui Kagaku)

Methyl ethyl ketone

The aforesaid coating solution compositions were dispersed by a sand mill for 20 hours. In the coating solution compositions, the weight ratio of the solid components were fixed so as to be CGM-1 :BX-L=3:1.

Next, by the use of the coating apparatus of the extrusion type as shown in FIG. 8, after the viscosity of the coating solution of the belowmentioned coating solution compositions CTL-1 (the solid component concentration was adjusted by adding a solvent), the gap of the slit 43, the flow quantity (the flow quantity adjustment of the force feed pump 3) were adjusted so as to make the absolute pressure P ($mmH_2O$) as shown in Table 1, and the coating was conducted so as to form the dry layer thickness of 30 $\mu$m on CGL-1, whereby coated drum Nos. 1-1, 1-2, 1-3 were obtained. The coating results were shown in table 1.

TABLE 1

| Coating solution Drum No. | 1-1 | 1-2 | 1-3 | 2-1 | 2-2 | 2-3 | 3-1 | 3-2 | 3-3 |
|---|---|---|---|---|---|---|---|---|---|
| Coating solution compositions | CGL-1 | CGL-1 | CGL-1 | CTL-2 | CGL-2 | CGL-2 | CTL-3 | CGL-3 | CGL-3 |
| Absolute pressure in a distributing chamber | 10000 | 50000 | 200000 | 5000000 | 20000 | 100000 | 4000000 | 40000 | 2000000 |
| Condition on the slide surface | D1 | B | B | D2 | D1 | B | D2 | B | B |
| Coating ability | E | B | B | E | E | B | E | B | A |

A: Very good

B: Good

D1: No good, becaouse disorder in flow was observed

D2: No good, becaouse fluctuation in flow was observed

E: Bad, becaouse coating irregularities occurred

CTL-1 Coating Solution Composition
CTM-1
Polycarbonate (viscosity molecular amount Mv 200 thousands) 1,2-dichloroethane The weight ratio of the solid components were fixed so as to be CTM-1:Polycarbonate=0.89:1.

EXAMPLE 2

Example 2 was conducted by the same manner in Example 1 except that CGL-2 and CTL-2 were used instead of CGL-1 and CTL-1 in Example 1, whereby coated drum Nos. 2-1, 2-2, 2-3 were obtained. The coating results were shown in table 1.

EXAMPLE 3

Example 3 was conducted by the same manner in Example 1 except that CGL-3 and CTL-3 were used instead of CGL-1 and CTL-1 in Example 1, whereby coated drum Nos. 3-1, 3-2, 3-3 were obtained. The coating results were shown in table 1.

CGL-2 Coating Solution Composition
Perylene type pigment (CGM-2)
Butyral resin (Eslec BX-L, made by Sekisui Kagaku)
Methyl ethyl ketone The aforesaid coating solution compositions were dispersed by a sand mill for 20 hours. In the coating solution compositions, the weight ratio of the solid components were fixed so as to be CGM-2:BX-L=2:1.

CGL-3 Coating Solution Composition
Y-type titanylphthalocyanine (CGM-3)
Silicone resin (KR-5240, made by Shin-etsu Kagaku)
T-butyl acetate
CTL-2 Coating Solution Composition
CTM-2
Polycarbonate (viscosity molecular amount Mv 300 thousands) 1,2-dichloroethane The weight ratio of the solid components were fixed so as to be CTM-1:Polycarbonate 0.89:1.

CTL-3 Coating Solution Composition
CTM-3
Polycarbonate (viscosity molecular amount Mv 400 thousands) 1,2-dichloroethane The weight ratio of the solid components were fixed so as to be CTM-1:Z-200=0.89:1.

According to the coating method and the coating apparatus of the present invention, as can be seen from Table 1 showing the results of Examples 1 to 3, it was learned that the flow-out of the coating solution was stable, that is, the behavior of the solution in the slit was stable, thereby reducing the coating irregularities (deviation in layer thickness). Further, in the present examples, bead discontinuity of the coating solution did not occur. Still further, multi-layers organic photoreceptors were composed by the above coated drums and actual image forming tests were conducted by the use of the multi-layers organic photoreceptors. In the test results, good images were obtained without causing image irregularities due to the coating irregularities.

EXAMPLE 4

As a conductive support of a cylindrical base member, a mirror-finished aluminum drum having a diameter of 80 mm and a height of 355 mm was used.

Coating was conducted by the use of the coating apparatus of the slide hopper type as shown in FIG. 7 after coating solution composition UCL-2 as shown below was prepared. Whereby coated drums were obtained.

UCL-2 Coating Solution Composition
Vinylchloride-vinylacetate copolymer (Eslec MF-10, made by
Sekisui Kagaku) 50 g
Acetone/cyclohexanone=10/1 (ratio by volume) 7000 ml The coating ability was good continuously from the initial coating to the coating for 1000th drum. Inventive example and comparative example

EXAMPLE 5

As a conductive support of a cylindrical base member, a mirror-finished aluminum drum having a diameter of 80 mm and a height of 355 mm was used.

Coating was conducted by the use of the coating apparatus of the slide hopper type as shown in FIG. 7 after coating solution composition CGL-2 as shown below was prepared. Whereby coated drums were obtained.

CGL-4 Coating Solution Composition
Perylene type pigment (CGM-2) 50 g
Butyral resin (Eslec BX-L, made by Sekisui Kagaku) 50 g
Methyl ethyl ketone 2400 ml The aforesaid coating solution compositions were dispersed by a sand mill for 20 hours.

CGM 1 to 3 and CTM 1 to 3 used in the above example were indicated below.

CGM-1

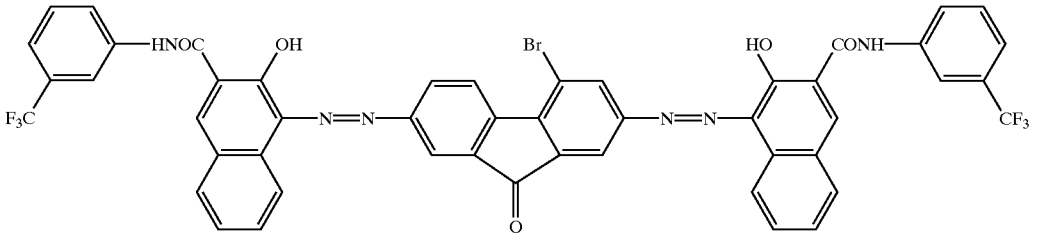

-continued

CGM-2

(1)

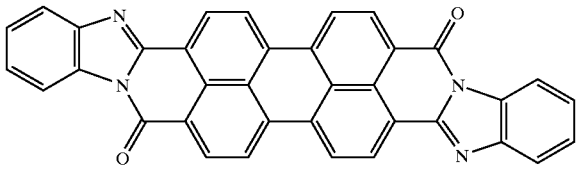

(2)

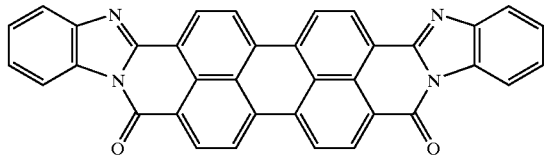

Mixture of (1) and (2)

CGM-3

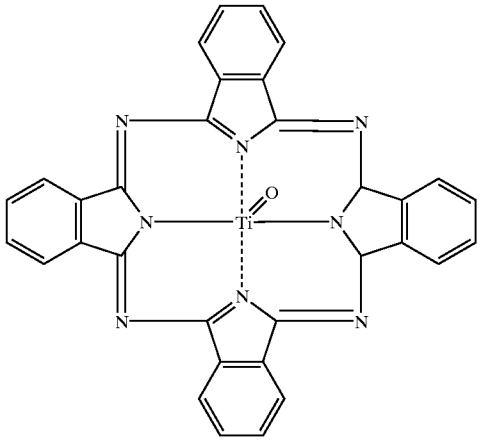

(Y-type titanylphthalocyanine)

CTM-1

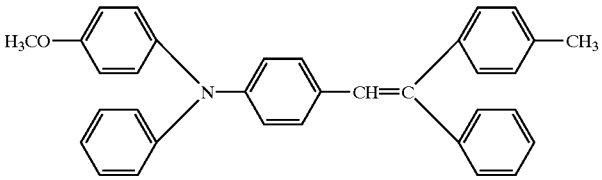

CTM-2

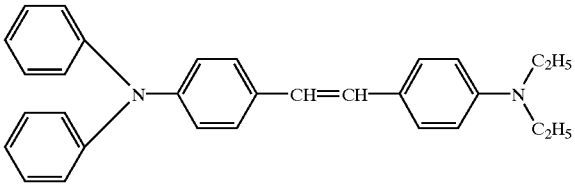

CTM-3

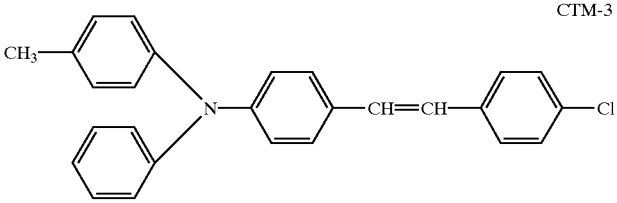

CTM-1

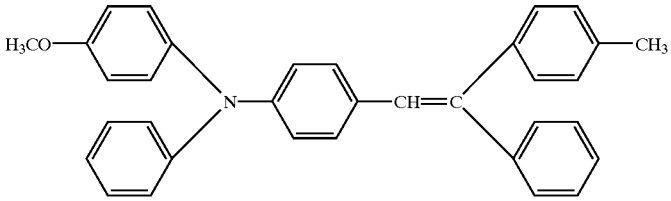

CTM-2

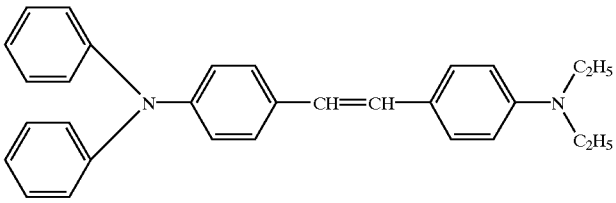

According to the present invention, in order to extract foam, foam extraction was conducted initially by increasing the quantity of coating solution. Thereafter, the quantity of coating solution was returned to the original quantity and the coating was started. As a result, flow-out of pigment coagula was stopped immediately after the coating was started. Further, the pigment coagula did not come out during the coating for a large number of drums. On the other hand, in the slide hopper type coating apparatus shown in FIG. 10, some of coagula flowed out on the slide surface 45 when 100th drum was coated, resulting in the occurrence of coating defects.

EXAMPLE 6

As a conductive support of a cylindrical base member, a mirror-finished aluminum drum having a diameter of 80 mm and a height of 355 mm was used.

Coating was conducted by the use of the coating apparatus of the slide hopper type as shown in FIG. 6 after coating solution composition CTL-1 as shown below was prepared. Whereby coated drums were obtained.

In the result of the coating, the coating ability was good without causing coating irregularities.

EXAMPLE 7

As a conductive support of a cylindrical base member, a mirror-finished aluminum drum having a diameter of 80 mm and a height of 355 mm was used.

By the use of the successive multi-layer coating apparatus as shown in FIG. 11, the coating solution compositions CGL-2 in Example 5 was coated so as to form the dry layer thickness of 0.5 μm on the coated drum No. 1-3 (the dry layer thickness of 1.0 μm) in Example 4, further, the coating solution compositions CTL-1 in Example 6 was successively coated so as to form the dry layer thickness of 23 μm on the above layer.

In the result of the coating, the coating ability and the multi-layer forming ability were very good and the coating irregularities in the longitudinal direction was not observed, thereby obtaining good quality image.

Further, actual image forming tests were conducted, good quality images were obtained without causing image irregularities due to the coating layer irregularities.

CTL-1 Coating Solution Composition

CTM-1 5000 g

Polycarbonate (Z-200, made by Mitsubishi Gas) 5600 g 1,2-dichloroethane 28000 ml In the result of the coating, the coating ability was good without causing coating irregularities.

By the use of the continuous multi-layer coating apparatus as shown in FIG. 2, the coating solution compositions CGL-2 in Example 5 was coated so as to form the dry layer thickness of 0.5 μm on the coated drum (the dry layer thickness of 1.0 μm) in Example 4, further, the coating solution compositions CTL-1 in Example 6 was successively coated so as to form the dry layer thickness of 23 μm on the above layer.

In the result of the coating, the coating ability and the multi-layer forming ability were very good and the coating irregularities in the longitudinal direction was not observed, thereby obtaining good quality image. Further, actual image forming tests were conducted, good quality images were obtained without causing image irregularities due to the coating layer irregularities.

According to the coating method and the coating apparatus of the present invention, by setting the absolute pressure in the coating solution distributing chamber and/or the viscosity of the coating solution within the predetermined range, the behavior of the solution in the slit becomes stable. Whereby deviations in layer thickness coated on the cylindrical base member can be reduced and the coating irregularities can be reduced.

Further, according to the coating method and the coating apparatus of the present invention, by making the sectional plane of the coating solution distributing chamber in the shape enclosed with a curved line, the following effects can be obtained. Flow-out of pigment coagula does not occur, the behavior of the solution in the slit becomes stable, the coating ability is good, the discontinuity of bead does not occur, deviations in layer thickness in the circumferential direction on the cylindrical base member does not occur, and the coating ability is not affected by the fluctuation in pulse motion of the fed solution. In particular, when the coating solution is fed out, since the fluctuation in pulse motion is eliminated and the deviations in coating solution layer thickness, irregularities in density level in an image when a number of copy sheets are formed does not occur.

What is claimed is:

1. A coating method of coating an outer circumferential surface of a cylindrical base with a coater having a supply port, a ring-shaped coating solution chamber, and a slit having a circular flow-out port, said slit connecting the circular flow-port with the coating solution chamber, the slit having a gap and the circular flow-out port being provided around an inner circumferential surface of the coater, comprising steps of feeding a coating solution from the supply port to the coating solution chamber so that the coating solution is discharged to the slit;

adjusting an absolute pressure P in the coating solution chamber by varying the gap of the slit, a viscosity of the coating solution and a flow quantity of the coating solution so as to satisfy the following formula:

$$3\times10^4 \leqq P \leqq 3\times10^6 \ (\mathrm{mmH_2O})$$

and relatively moving the cylindrical base through a hole formed by the inner circumferential surface of the coater so that an outer circumferential surface of the cylindrical base is uniformly coated with the coating solution flowing out from the slit.

2. The method of claim 1, wherein the absolute pressure is adjusted so as to satisfy the following formula:

$$5\times10^4 \leqq P \leqq 1\times10^6 \ (\mathrm{mmH_2O})$$

3. The method of claim 1, wherein a viscosity of the coating solution is 500 to 10000 milipascal·sec.

4. The method of claim 1, wherein the coater is an extrusion coater to extrude the coating solution through the slit by the pressure P.

* * * * *